United States Patent [19]

Luchsinger

[11] 4,181,240

[45] Jan. 1, 1980

[54] FLEXIBLE DISPENSER FOR FLEXIBLE SHEETS

[76] Inventor: Charles R. Luchsinger, 14 Briarwood Dr., Glen Cove, N.Y. 11542

[21] Appl. No.: 933,232

[22] Filed: Aug. 14, 1978

Related U.S. Application Data

[63] Continuation of Ser. No. 768,299, Feb. 14, 1977, abandoned.

[51] Int. Cl.[2] ..... B65H 3/52

[52] U.S. Cl. ..... 221/39

[58] Field of Search ..... 221/39, 40, 36, 41, 221/55, 259, 213; 271/19, 24, 25, 21-23; 84/486

[56] References Cited

U.S. PATENT DOCUMENTS

| | | | |
|---|---|---|---|
| 933,633 | 9/1909 | Pollock | 221/41 |
| 1,003,558 | 9/1911 | Welsh | 271/24 |
| 3,168,212 | 2/1965 | Edwards | 221/39 |

*Primary Examiner*—Stanley H. Tollberg
*Attorney, Agent, or Firm*—Arthur A. March

[57] ABSTRACT

A flexible dispenser for dispensing the top sheet of flexible material from a sheaf or pile of flexible materials such as paper, comprising an anchor for anchoring the dispenser, for example, in the form of a flange to be interposed between the top edge of a sheaf of paper and the front wall of a receptacle containing such paper, and a flexible or partially flexible relatively elongate dispensing member as such dispenser extending over the top sheet of paper and provided near its bottom edge with friction gripping substance on the top and bottom surfaces whereby when the dispensing member is moved rearwardly away from the point of ultimate emission of the paper, it will bow into a convex configuration causing the top sheet of paper to assume a similar configuration causing it to lift away from the remainder of the material in the sheaf and become available to be grasped for removal from the receptacle.

14 Claims, 9 Drawing Figures

FLEXIBLE DISPENSER FOR FLEXIBLE SHEETS

This is a continuation of application Ser. No. 768,299 filed on Feb. 14, 1977 now abandoned.

BACKGROUND OF THE INVENTION

It is often necessary to dispense only the top sheet from a sheaf of papers. For example, the dispensing of the top sheet is customary practice when using memo paper contained within a tray, one sheet of typewriter paper from a pile, or a sheet of photographic paper from a box, etc. As a consequence, there have been several suggestions made to accomplish the single sheet dispensing. Usually, the suggested dispenser has comprised relatively rigid means with a continuous friction thrust being applied in the direction of the emission of the paper from the container. For example, in U.S. Pat. No. 2,588,152, such rigid means are attached to the hinged top cover of a box containing the paper and, when the cover is closed, the forward edge of the rigid member contacts the top sheet of paper and pushes it forward, moving it up a ramp provided for the purpose and thereafter out of the box. Somewhat similar means are shown in U.S. Pat. No. 2,290,006 in which a rigid roller is used for this purpose. In U.S. Pat. No. 2,434,254 a dispensing roller attached to a stiff movable member moves the paper through a hinged side of the box containing the paper. Another proposal in U.S. Pat. No. 2,032,150 is the provision of an adhesive pad which when pressed down on the sheaf of paper will adhere to the top sheet whereupon the top sheet can be lifted and removed. An adhesive-faced roller supported by a relatively stiff spring member is used to urge surgical napkins out of a dispensing unit according to the suggestion of U.S. Pat. No. 1,730,126.

Thus most of the proposals heretofore made involved the provision of relatively rigid means adapted to move the top sheet of paper in the direction of its emission from the box or container or to physically lift the top sheet from the box by adhesive means. For the most part, the proposals heretofore made provided relatively expensive dispensing structure which was quite difficult to manipulate and control and sometimes utilized substances, such as adhesives, which might become applied to and deteriorate the quality of the paper itself. The problems involved in connection with the dispensing of single sheets of paper from a sheaf of papers have continued and have remained relatively unsolved over some period of time.

SUMMARY OF THE INVENTION

The present invention overcomes the aforesaid difficulties and problems by providing a flexible relatively inexpensive arrangement whereby the top sheet of a sheaf of papers may be dispensed with ease and facility. This is accomplished without in any way causing damage to the paper itself or placing any adhesive deposit thereon. The device of the present invention is easily manipulatable. The uniqueness of the discovery involved in this invention encompasses a concept quite contrary to the normally expected proposals for the solution of such a problem.

As aforesaid, the attempts overcoming the problems heretofore made involved moving the top sheet of paper in the direction of the exit point from the box or lifting the top sheet bodily off the sheaf of papers.

The present invention provides a flexible means which extends from one edge of the sheaf of papers, which edge will be hereinafter referred to as the "upper edge", toward the opposite edge of the sheaf, which will hereinafter be referred to as the "bottom edge". The concept involves a flexible or partially flexible sheet preferably in the form of a relatively elongate member or tab. One end of the tab is adapted to be placed adjacent to the upper edge of the sheaf of papers. The tab would then extend from the upper edge of the sheaf over the top of the sheaf toward the bottom edge thereof. This relatively elongate member or tab is provided at or near its bottom end with friction engaging means on both sides of the tab. The device of the present invention is so constructed, as aforesaid, that when it is in position overlying the sheaf of papers and a pressure is exerted by the engagement of the fingers or hand of the user with the friction means on the top of the tab, such pressure will cause engagement between the friction means on the underside of the tab and the top sheet of the sheaf of papers. Movement under such pressure of the tab toward the upper edge of the sheaf of papers will cause the flexible tab to bow and assume a relatively convex position. Under the same pressure, it has been found that the top sheet of the sheaf of papers will also flex and bow to assume a convex shape conforming at least in part to the convex configuration of the tab. It is noteworthy that in such operation only the top sheet will move unless the paper is of a completely unusual sticky type. Continued exertion of the pressure causes the top sheet to bow to the extent that the front edge thereof is partially lifted from the sheaf whereby the single sheet can be grasped with ease and facility and withdrawn from the remainder' of the sheaf.

Under certain conditions, a mere release of the pressure exerted upon the dispensing member will cause the single sheet heretofore bowed to move forward as it returns downwardly whereupon it will extend over the forward edge of the container or the like to be then removed.

It has been found to be particularly advantageous to provide the tab with a relatively stiff portion adjacent the upper edge of the sheaf of papers with a flexible portion extending from said stiff portion. This structure maintains some degree of pressure on the upper edge of the sheaf while permitting the aforesaid flexibility in the central and bottom or outer portions of the tab so that a highly desirable flexing and bowing action is obtained for both the dispensing means and the top sheet of paper which follows the configuration of the dispensing means.

In instances where the paper itself is not of the same degree of flexibility as conventional paper, as is the case with photographic paper, similar dispensing means to those described above can be utilized. However, to assist in the obtaining of the flexed or bowed position, the paper may itself be somewhat larger from its top edge to its bottom edge than the dimension between the top and bottom edges of the box containing the paper. In this condition, the paper would be pre-bowed within the box and the start of the sequence of emission of the top sheet described above would be facilitated. Furthermore, the box itself may be provided with a supporting ledge extending transversely intermediate the box and underneath the sheaf of papers to maintain it in a bowed position prior to the institution of the emitting operation.

Thus, a flexible dispensing means is provided which is so constructed as to be movable in the first instance in a direction opposite to the direction of the emission of the top sheet from the sheaf of papers and the box which is quite contrary to conventional proposals on the subject. This movement with pressure applied to the top sheet causes it to conform to the convex or bowed configuration of the dispensing means whereupon the single sheet of paper can be grasped by the hand or upon release of pressure will move forwardly as well as downwardly for separation from the remainder of the sheaf and emission from the box or container.

The following description discloses preferable forms of embodiments of the present invention in such detail as to enable an understanding thereof with facility. It is not intended and does not however, in any way limit the scope of the invention.

DESCRIPTION OF THE DRAWINGS

Figure 1:
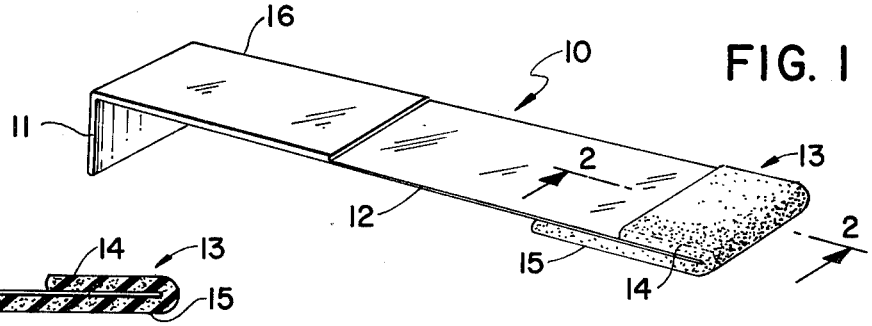
FIG. 1 is a perspective view of the dispensing means of the present invention.
Figure 2:
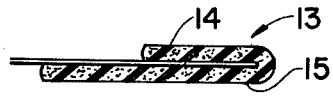
FIG. 2 is a section taken along the lines 2—2 of FIG. 1.

According to the embodiment shown in FIGS. 1 through 6, the dispensing means 10 of the present invention comprises a generally flexible member at least a portion of which is capable of being bowed into a convex configuration. The flexible member 10 as shown comprises an angularly disposed position retaining anchor illustratively displayed as a flange 11, and a flexible portion 12 which is adapted to overlay the top sheet of a sheaf of papers as will be hereinafter described. The dispensing member 10, as illustrated, comprises a relatively elongate tablike member of plastic material although, of course, the illustration of a member of particular dimension and material is in no way intended to limit this invention to the illustrated form.

Friction engaging means is disposed at or near the end of the dispensing member opposite anchoring flange 11. The friction engaging means is of such size that it will not interfere with but will assist in the flexing or bowing of the dispensing member in the substantially central portion 12. Preferably, the friction engaging means 13 comprise a friction member 14 disposed on the upper surface of the tab and a friction member 15 disposed on the lower surface of the tab which will respectively hereinafter be termed the "upper friction member" and the "lower friction member". As illustrated, the upper and lower friction members comprise one strip of foam-like material such as polyurethane foam extending from the top of the flexible tab around the end to the underside of the flexible tab. This showing is to be considered as merely illustrative, as the upper friction member 14 which constitutes a control receptive friction engaging means and the lower friction member 15 which constitutes a control imparting friction engaging means may comprise individual pieces made of a variety of materials which may be locatable at any point along the flexible member which does not interfere with the flexing or bowing thereof, yet it is clear that such control receptive friction engagement means and control imparting friction engagement means will be stationary in nature and fixed in position regardless of where they are located.

If desired, and under certain conditions, the portion of the flexible member 10 immediately adjacent to the flange 11 may comprise relatively stiff material 16 such as paper board which will act to some extent as a pressure exerter on the upper portion of the sheaf of papers and assist in the bowing of the flexible portion 12 when performing its dispensing operation.

Figure 3:
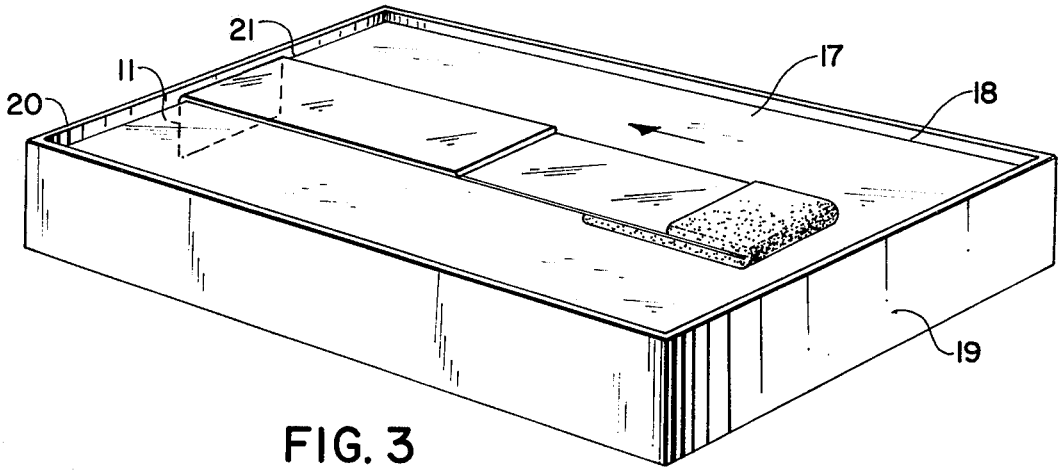
FIG. 3 is a perspective view of the dispensing means of the present invention in position over a box containing a sheaf of papers.

The dispensing member 10 is shown in FIG. 3 in proper position over the top sheet 17 of a sheaf of papers 18 contained within a receptacle 19. As illustrated, the position retaining flange 11 is disposed between the inner side of the front wall 20 of the receptacle or box 19 and the upper edge 21 of the sheaf of papers. Thus the dispensing member may accompany the box of paper or it may be distributed as a separate insertable member. It is to be understood that the illustrated form of position retaining means shown as flange 11 may take any shape necessary in order to maintain the dispensing means 10 in the appropriate position overlying the top sheet 17 of the sheaf of papers 18. As a result while the entire dispensing means cannot be moved as a unit, there is no interference with the flexing or bowing action of the flexible portion 12. This stop may be accomplished by any suitable means whether within or outside the box and the showing of one form of such position retaining means is merely to assist in the understanding of the invention.

When it is desired to dispense the top sheet of paper from a sheaf of stacked sheets of papers, it is only necessary to exert pressure on the upper friction member 14 as control receptive friction engaging means whereupon corresponding pressure will be exerted on the bottom friction member 15 as control imparting friction engaging means. Movement of the friction members such as, for example, the fingers of a hand in the direction of the arrow in FIG. 3 will cause a flexing or bowing of the flexible dispensing member to the convex position illustrated in FIG. 4. This movement is opposite to the direction of ultimate dispensing of the sheet of paper from the sheaf. Thus, the flexible portion 12 is locally bowable intermediate its end portions out of its normal disposition upon rearward movement thereof in a direction towards the anchor or flange 11.

Figure 4:
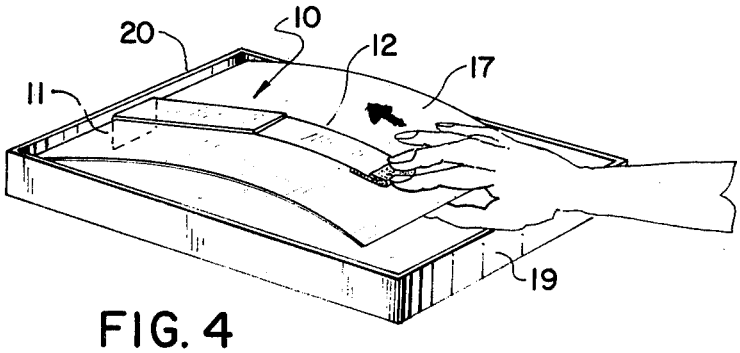
FIG. 4 is a perspective view of the dispensing means of the present invention in the first sequence of dispensing one sheet of paper from the remainder of the sheaf of papers in the box.

As shown in FIG. 4, continued rearward motion of the fingers of a hand, under the exerted pressure, will cause bowing or flexing of the top sheet of paper 17 which assumes substantially the same convex configuration of the flexible portion 12 of the dispensing member 10. The dispensing member, because of the inventive concept, cannot be moved in its entirety in any direction because of the contact of the stop or position retaining flange 11 with the wall 20 of the box 19 and thus the desirable convex bowing action is accomplished with ease and facility.

Accordingly, the retaining anchor, e.g. in the form of flange 11, constitutes a freely situated spatially self-disposingly restable anchor means having a corner portion arranged for horizontally stationarily disposed vertically downward resting contact against the adjacent corresponding top corner edge along a portion of the particular side of the sheaf of stacked flexible sheets thereat, i.e. arranged insertedly between the wall portion of the receptable, as at wall 20 of box 19, and the top corner edge of the sheaf.

Figure 5:
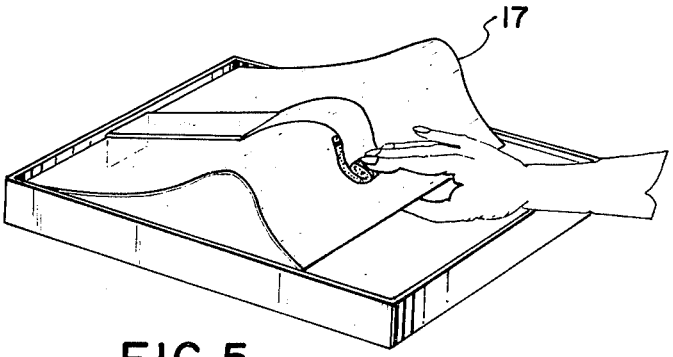
FIG. 5 is a perspective view of the dispensing means of the present invention in the second sequence of dispensing one sheet of paper from the remainder of the sheaf of papers in the box.
Figure 6:
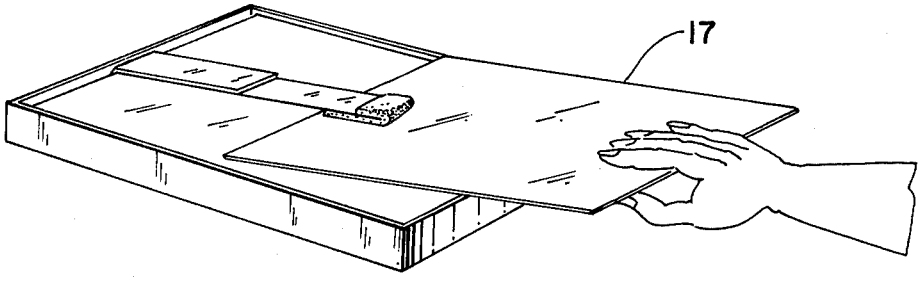
FIG. 6 is a perspective view of the dispensing means of the present invention in the last sequence of dispensing one sheet of paper from the remainder of the sheaf of papers in the box.

The next step of the dispensing operation is illustrated in FIG. 5 wherein the continued exerted rearward pressure on the dispensing member 10 causes it to partially spring forward or away from the sheaf of papers carrying with it the single sheet 17 which has been previously bowed to substantially the same configuration. In this position, the single top sheet of paper can be easily removed by simple manipulation of the same hand which had been exerting the pressure or by the use of the other hand. As a result of the spring action obtained by the attainment of the ultimate convex position of the paper, it is also possible to simply relieve the pressure on the dispenser 10 whereupon the top sheet of paper 17 will spring forward as well as downward.

Due to the arrangement and the construction of the dispensing member, the initial thrust for dispensing of the paper is in an unusual direction in that means are provided for paper to be dispensed away from the area of its ultimate destination.

Figure 7:
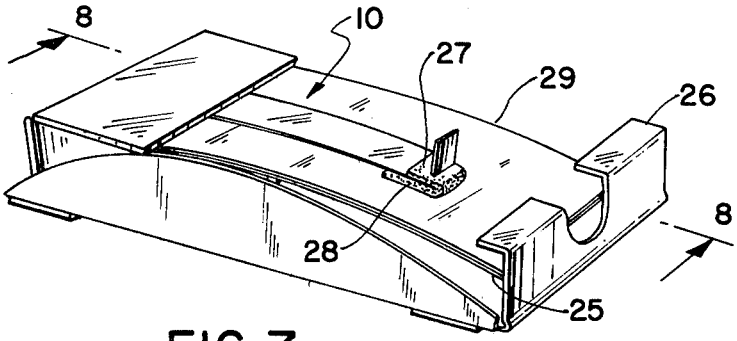
FIG. 7 is a perspective view of a modified form of the present invention in which the dispensing paper is dispensed within a receptacle whose dimensions from the top edge to the bottom edge are smaller than the dimensions of the paper from the top edge to the bottom edge.
Figure 8:
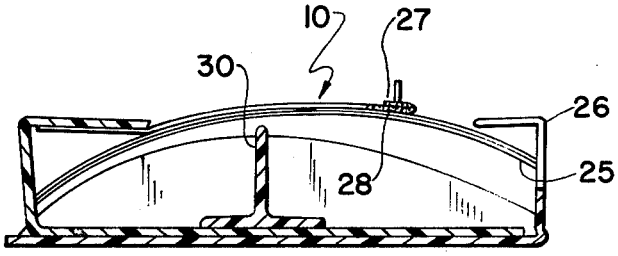
FIG. 8 is a section taken along the lines 8—8 of FIG. 7.
Figure 9:
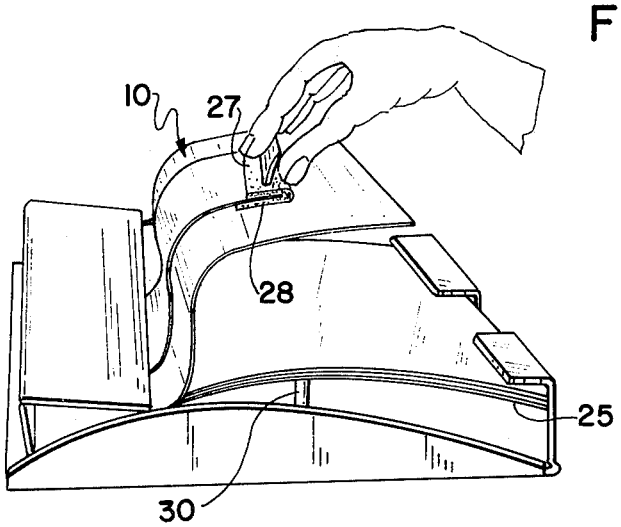
FIG. 9 is a perspective view of the modified form of the present invention showing the first sequence of the dispensing operation.

As shown in FIG. 7 through 9, which discloses a modified version of the present invention, the concept may be used in connection with the dispensing of relatively stiff as well as the normal highly flexible paper. Such relatively stiff paper includes photographic paper, etc. There are difficulties which may be encountered in obtaining the appropriate flexing and bowing action, should such relatively stiff paper be attempted to be moved under the pressure above described. As a consequence, the present invention provides a structure which will assist in the institution of the desired flexing and bowing action before the exertion of pressure. This structure is shown in FIGS. 7–9 wherein the length of the paper in the sheaf of papers 25 is longer than the length of the box 26. As a consequence, the paper is initially bowed into a convex position, as shown, whereupon by grasping the upper pressure member 27 with the fingers of the hand and pressing downwardly and rearwardly, pressure contact will be exerted between the lower pressure member 28 and the top sheet 29 of the sheaf of papers 25. This action causes additional bowing of the top sheet away from the remaining sheaf of papers 25. The top sheet of paper 29 is thus available for grasping by the hand of the user or will spring forward as well as downward when pressure is released to facilitate its dispensing from the box 26. As shown, there is a modified form of the upper friction member 27 itself which is provided with a tab portion 28 which can be grasped between the fingers while pressing downwardly upon the front portion of the dispensing member 10. Here also, the flexible portion of dispensing member 10 is locally bowable intermediate its end portions out of its normal disposition upon movement in rearward direction.

The back wall of the box may be made of a movable piece which can be adjusted in order that the area containing the paper may be smaller in length than the length of the paper itself for the purposes above described. In addition, the paper may be retained in its bowed position by a slot provided in the front wall of the box itself or any other suitable means for maintaining the initial bowed position of the paper.

Also, if desired, the initialed bowed position of the paper within the box may be sustained and maintained by a support plate 30 which extends laterally across the bottom of the box under the sheaf of papers, e.g. as a ledge, in a somewhat central location. This structure will maintain the paper in its pre-bowed condition at all times and is especially useful when heavy, relatively nonflexible paper is being dispensed.

The dispensing member 10 may be, of course of any suitable material which will accomplish the desired result such as flexible plastic strip material, cloth fabric, webbing material or the like, i.e. a material being locally bowable intermediate its end portions out of its normal disposition and also being spatially self-disposingly restable for self-disposing resting contact on the top sheet of the sheaf of stacked sheets, and the upper and lower friction pressure members may also be provided of any suitable type of gripping or pressure active or activating means which preferably do not interfere with the characteristics and quality of the paper itself. Furthermore, when a relatively stiff piece 16 is utilized as a part of the dispensing member 10, this too may be comprised of any suitable stiffening material which can accomplish the purpose intended by the concept of the invention. On the other hand, as is clear from the foregoing, and especially from FIGS. 5 and 9, the locally bowable material itself is in fact infinitely locally bowable at any and all points intermediate its end portions.

Thus, there has been provided by the present invention a simple, unusual and movel dispensing means whereby a specific sheet of paper can be dispensed with facility from a sheaf without in any way detracting from the character or the quality of the paper itself.

While the invention has been described in detail in accordance with specific embodiments, it will be understood that this detailed description is merely provided to facilitate a complete understanding of the invention and that variations and modifications may be made without departing from the spirit of the invention as defined in the appended claims.

I claim:

1. A dispenser for a flexible sheet of material from a sheaf of stacked flexible sheets comprising a freely situated spatially self-disposingly restable anchor means having a corner portion arranged for horizontally stationarily disposed vertically downward resting contact against the top corner edge along a portion of one of the sides of the sheaf of stacked flexible sheets, a spatially self-disposingly restable flexible member extending forwardly from said anchor means to overlie the top sheet of such sheaf of stacked flexible sheets in self-disposing resting contact thereon and being locally bowable intermediate its end portions out of its normal disposition upon rearward movement of such flexible member in a direction towards said anchor means, and stationary control imparting friction engaging means disposed on the underside of said flexible member whereby downwardly pressing rearward movement of said flexible member causes said member to bow into a relatively convex configuration and said friction engaging means to engage operatively with the top sheet of said sheaf, whereupon the top sheet bows into a similar relatively convex configuration and is moved away from the remaining sheets of the sheaf for the dispensing of said top sheet.

2. The dispenser of claim 1 in which said anchor means comprises a flange of relatively stiff material.

3. The dispenser of claim 1 including control receptive friction engaging means on the upper side of said flexible member substantially opposite said friction engaging means on the underside of said flexible member.

4. The dispenser of claim 3 in which the friction engaging means on the underside and on the upper side of said flexible member comprise a single strip of friction material.

5. The dispenser of claim 3 in which the friction engaging means on the underside and on the upper side of said flexible member comprises polyurethane foam.

6. The dispenser of claim 1 in which a portion of said flexible member extending forwardly from said anchor means is of relatively stiff material.

7. The dispenser of claim 1 in which the flexible means are relatively elongate and narrower in width than the width of the sheaf of stacked flexible sheets.

8. A manual dispenser for a flexible sheet of material from a sheaf of stacked flexible sheets comprising a freely situated spatially self-disposingly restable anchor means having a corner portion arranged for horizontally stationarily disposed vertically downward resting contact against the top corner edge along a portion of one of the sides of the sheaf of stacked flexible sheets, a spatially self-disposingly restable flexible member having first and and second portions extending forwardly from said anchor means to overlie the top sheet of such sheaf of stacked flexible sheets, the first portion of said flexible member being adjacent to said anchor means and being of relatively stiff material and the second portion of said flexible member being remote from said anchor means and composed of spatially self-disposingly restable flexible material for overlying the top sheet of such sheaf in self-disposing resting contact thereon and being infinitely locally bowable at any point intermediate the end portions of such second portion out of its normal disposition upon rearward movement thereof in a direction towards said anchor means, stationary control receptive friction engaging means on the upper side of the second portion of said flexible member at a location farthest from said anchor means, and stationary control imparting friction engaging means disposed on the underside of said flexible member substantially opposite said control receptive friction engaging means on the upper side of said flexible member whereby downwardly pressing rearward movement of the second portion of said flexible member causes said second portion to bow into a relatively convex configuration intermediate the end portions of said second portion and said control imparting friction engaging means to engage operatively with the top sheet of said sheaf, whereupon the top sheet bows into a similar relatively convex configuration and is moved away from the remaining sheets of the sheaf for the dispensing of said top sheet.

9. A receptacle having a wall portion for dispensing a flexible sheet of material from a sheaf of stacked flexible sheets contained by the wall portion within the receptacle and including a dispenser comprising a freely situated spatially self-disposingly restable anchor means having a corner portion arranged insertedly between the wall portion and top corner edge along a portion of one of the sides of the sheaf of stacked flexible sheets for resting contact against such top corner edge, a spatially self-disposingly restable flexible member extending forwardly from said anchor means to overlie the top sheet of such sheaf of stacked flexible sheets in self-disposing resting contact thereon and being infinitely locally bowable intermediate its end portions out of its normal disposition upon rearward movement of such flexible member in a direction towards said anchor means, and stationary control imparting friction engaging means disposed on the underside of said flexible member whereby downwardly pressing rearward movement of said flexible member causes said member to bow into a relatively convex configuration and said friction engaging means to engage operatively with the top sheet of said sheaf, whereupon the top sheet bows into a similar relatively convex configuration and is moved away from the remaining sheets of the sheaf for the dispensing of said top sheet from the receptacle.

10. The invention as described in claim 9 including control receptive friction engaging means on the upper side of said flexible member substantially opposite said friction engaging means on the underside of said flexible member.

11. The invention as described in claim 9 in which the receptacle has a rear wall and said anchor means comprises a flange of relatively stiff material disposed between the top edge of the sheaf of flexible sheets and said rear wall.

12. A receptacle for dispensing a flexible sheet of material from a sheaf of stacked flexible sheets contained within the receptacle, said receptacle having a rear wall and a front wall which are spaced apart a distance which is less than the length of the sheets in the sheaf of stacked flexible sheets to be dispensed whereby the flexible sheets are disposable in a convex configuration within the receptacle, and said receptacle including a dispenser comprising anchor means, a flexible member extending forwardly from said anchor means to overlie the top sheet of such sheaf of stacked flexible sheets, and control imparting friction engaging means disposed on the underside of said flexible member whereby downwardly pressing rearward movement of said flexible member causes said member to bow into a relatively convex configuration and said friction engaging means to engage operatively with the top sheet of said sheaf, whereupon the top sheet bows into a similar relatively convex configuration and is moved away from the remaining sheets of the sheaf for the dispensing of said top sheet from the receptacle.

13. The invention as defined in claim 12 including support means for maintaining the flexible sheets in said convex configuration within the receptacle.

14. The invention as defined in claim 13 in which said support means comprise a ledge extending transversely of said receptacle between the rear and front walls.

* * * * *